US008985073B2

(12) United States Patent
Kanai

(10) Patent No.: US 8,985,073 B2
(45) Date of Patent: Mar. 24, 2015

(54) OIL SUPPLY APPARATUS FOR INTERNAL COMBUSTION ENGINE

(75) Inventor: Hiroshi Kanai, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/367,737

(22) Filed: Feb. 7, 2012

(65) Prior Publication Data

US 2012/0204823 A1 Aug. 16, 2012

(30) Foreign Application Priority Data

Feb. 10, 2011 (JP) ..... 2011-026855

(51) Int. Cl.
*F01L 9/02* (2006.01)
*F01L 1/344* (2006.01)

(52) U.S. Cl.
CPC ..... *F01L 1/3442* (2013.01); *F01L 2001/3443* (2013.01); *F01L 2001/34469* (2013.01); *F01L 2800/01* (2013.01); *F01L 2800/03* (2013.01)
USPC ..... 123/90.12; 123/90.17

(58) Field of Classification Search
CPC ..... F02L 1/3442
USPC ..... 123/90.12, 90.15, 90.17, 90.34, 196 M, 123/179.16, 179.18; 701/103, 113
See application file for complete search history.

(56) References Cited

U.S. PATENT DOCUMENTS 5,915,348 A * 6/1999 Scheidt et al. ..... 123/90.17
7,225,775 B2 * 6/2007 Ogawa ..... 123/90.17
2009/0071140 A1 * 3/2009 Knecht et al. ..... 60/420
2009/0311115 A1 * 12/2009 Ono et al. ..... 417/279
2011/0146602 A1 * 6/2011 Kato ..... 123/90.12

FOREIGN PATENT DOCUMENTS

JP 04-287815 A 10/1992
JP 07-109907 A 4/1995
JP 2000-154739 A 6/2000
JP 2009-041445 A 2/2009
JP 2009-144605 A 7/2009

OTHER PUBLICATIONS

Japanese Office Action for corresponding JP Patent Application No. 2011-026855 issued on Apr. 3, 2013.

* cited by examiner

*Primary Examiner* — Thomas Denion
*Assistant Examiner* — Daniel Bernstein
(74) *Attorney, Agent, or Firm* — Sughrue Mion, PLLC

(57) ABSTRACT

An oil supply apparatus includes an oil pump that is driven by an internal combustion engine; a supply passage that is connected to a discharge side of the oil pump; a lubricant passage that leads hydraulic fluid from the supply passage to a portion to be lubricated that is provided in the internal combustion engine; a hydraulic passage that leads hydraulic fluid from the supply passage to a variable valve mechanism; a flow regulating valve capable of regulating a flowrate of hydraulic fluid that flows through the lubricant passage; and a control apparatus that controls the flow regulating valve in a closing direction at startup of the internal combustion engine such that a pressure of hydraulic fluid that is led to the variable valve mechanism when the internal combustion engine is being cranked comes to be equal to or greater than a predetermined target pressure.

5 Claims, 5 Drawing Sheets

OIL SUPPLY APPARATUS FOR INTERNAL COMBUSTION ENGINE

INCORPORATION BY REFERENCE

The disclosure of Japanese Patent Application No. 2011-026855 filed on Feb. 10, 2011 including the specification, drawings and abstract is incorporated herein by reference in its entirety.

BACKGROUND OF THE INVENTION

1. Field of the Invention

The invention relates to an oil supply apparatus for an internal combustion engine provided with a variable valve mechanism that is driven by hydraulic pressure.

2. Description of Related Art

An internal combustion engine is known that is provided with a variable valve mechanism driven by hydraulic pressure, and in which a lubricant passage that leads oil to portions that need lubricating provided in the internal combustion engine, and a hydraulic passage that leads oil to a hydraulic pressure regulating valve of the variable valve mechanism, are provided branching off from a discharge side passage of an oil pump. Also, Japanese Patent Application Publication No. 04-287815 (JP-A-04-287815), for example, describes an apparatus in which a variable throttle valve is provided in the lubricant passage of such an internal combustion engine. This apparatus increases the hydraulic pressure in the hydraulic passage by throttling the variable throttle valve when the internal combustion engine is operating in a low speed region. Other related art includes Japanese Patent Application Publication No. 07-109907 (JP-A-07-109907) and Japanese Patent Application Publication No. 2009-041445 (JP-A-2009-041445).

With the apparatus in JP-A-04-287815, the variable throttle valve is fully opened when the speed of the internal combustion engine is within an extremely low speed region that includes idling speed. As a result, while the internal combustion engine is being cranked, the hydraulic pressure may be insufficient, and consequently, the variable valve mechanism may not operate.

SUMMARY OF THE INVENTION

Therefore, the invention provides an oil supply apparatus for an internal combustion engine that enables a variable valve mechanism to be operated from the time of startup of an internal combustion engine.

A first aspect of the invention relates to an oil supply apparatus applied to an internal combustion engine provided with a variable valve mechanism that is driven by hydraulic pressure. This oil supply apparatus includes an oil pump that is driven by the internal combustion engine; a supply passage that is connected to a discharge side of the oil pump; a lubricant passage that leads hydraulic fluid from the supply passage to a portion to be lubricated that is provided in the internal combustion engine; a hydraulic passage that leads hydraulic fluid from the supply passage to the variable valve mechanism; a flow regulating valve capable of regulating a flowrate of hydraulic fluid that flows through the lubricant passage; and a control apparatus that controls the flow regulating valve in a closing direction at startup of the internal combustion engine such that a pressure of hydraulic fluid that is led to the variable valve mechanism when the internal combustion engine is being cranked comes to be equal to or greater than a predetermined target pressure.

According to the oil supply apparatus of this aspect of the invention, the flow regulating valve is controlled in the closing direction when the internal combustion engine is being started up, and as a result, the pressure of hydraulic fluid that is led to the variable valve mechanism when the internal combustion engine is being cranked may be quickly made equal to or greater than the target pressure. Therefore, the variable valve mechanism can be operated from the time that the internal combustion engine is started, by appropriately setting the target pressure.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
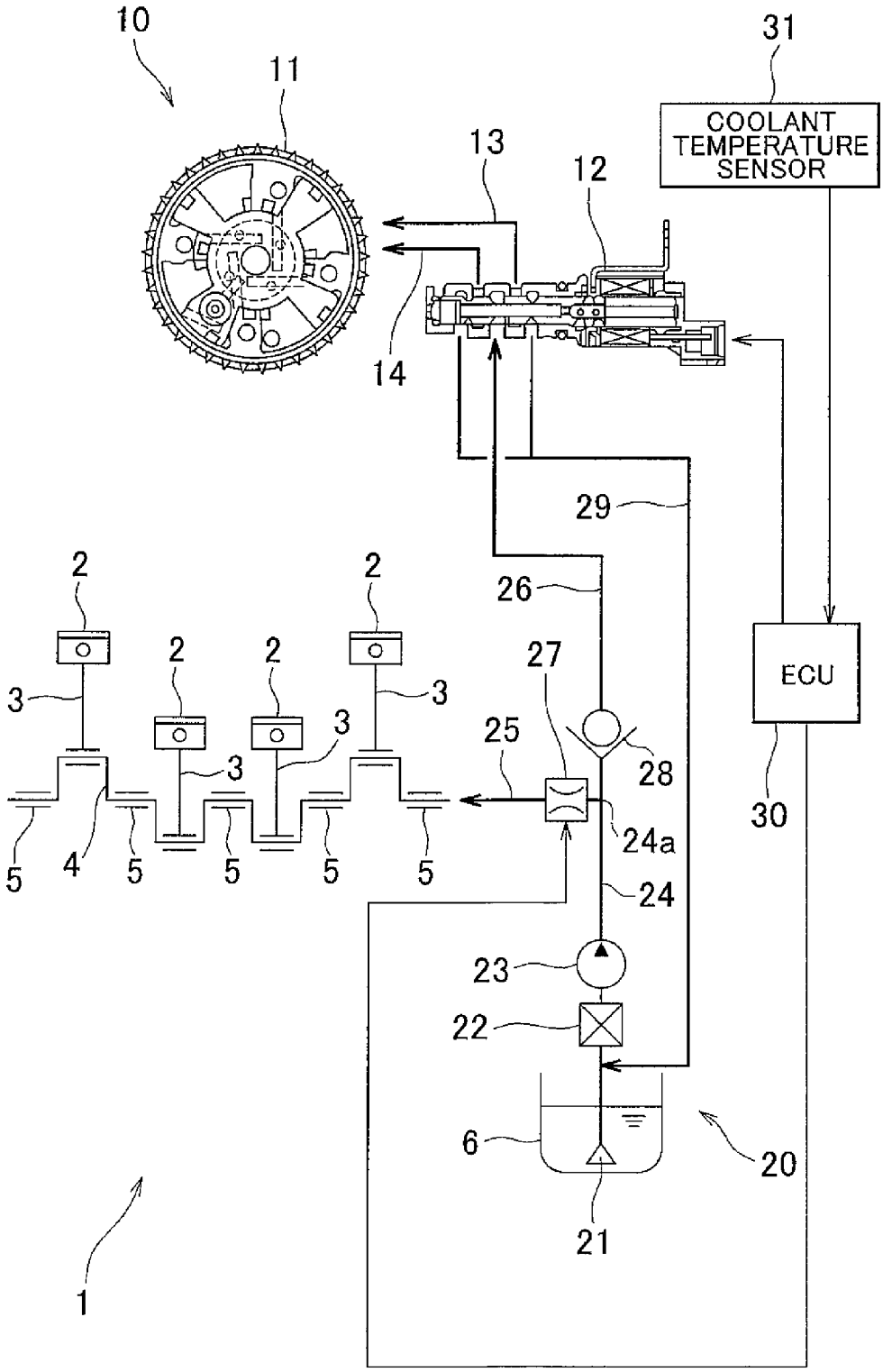
FIG. 1 is a view schematically showing an internal combustion engine into which an oil supply apparatus according to an example embodiment of the invention has been incorporated.

FIG. 1 is a view schematically showing an internal combustion engine into which an oil supply apparatus according to an example embodiment of the invention has been incorporated. This internal combustion engine (hereinafter also simply referred to as "engine") 1 is mounted as a power source in a hybrid vehicle. This engine 1 is configured to be able to operate at a high expansion ratio in which the expansion ratio is essentially larger than a compression ratio, by adjusting the closing timing of an intake valve. The engine 1 has four cylinders, not shown. A piston 2 is inserted into each cylinder so as to be able to move in a reciprocating manner. Each of the pistons 2 is connected to a crankshaft 4 by a connecting rod 3. The crankshaft 4 is supported by an engine main body, not shown, of the engine 1 by a plurality of bearings 5. An oil pan 6 in which oil is stored is provided at a lower portion of the engine main body. These portions are the same as those of a well-known engine, and thus detailed descriptions thereof will be omitted. Also, although not shown, a motor-generator that functions as both an electric motor and a generator is mounted as a power source in this vehicle. The cranking of the engine 1 is performed by this motor-generator.

The engine 1 has an intake-side camshaft and an exhaust-side camshaft (neither of which is shown) that are driven by the crankshaft 4. A plurality of cams for driving the intake valve of each cylinder open and closed is provided on the intake-side camshaft, and plurality of cams for driving the exhaust valve of each cylinder open and closed is provided on the exhaust-side camshaft. Also, the engine 1 includes a variable valve mechanism 10 that is capable of changing the valve characteristics (such as the opening and closing timings, the operation angle, and the like) of the intake valve of each cylinder. This variable valve mechanism 10 includes an actuator 11 that changes the phase of the intake-side camshaft with respect to the crankshaft 4 using hydraulic pressure. The actuator 11 has two chambers inside of it. One of the chambers is an advance chamber for advancing the phase of the intake-side camshaft with respect to the crankshaft 4, and the other is a retard chamber for retarding the phase of the intake-side camshaft with respect to the crankshaft 4. The variable valve mechanism 10 has an oil control valve (OCV) 12 for controlling the hydraulic pressure in both the advance chamber and the retard chamber. The OCV 12 is connected to the advance chamber by an advance chamber-side fluid passage 14, and the OCV 12 is connected to the retard chamber by a retard chamber-side fluid passage 13. This variable valve mechanism 10 changes the valve characteristics of the intake valve by advancing or retarding the phase of the intake-side camshaft with respect to the crankshaft 4, which is achieved by regulating the hydraulic pressure in both the advance chamber and the retard chamber using the OCV 12. The structure and control method of the variable valve mechanism 10 are the same as those of a well-known mechanism provided in an internal combustion engine, so detailed descriptions thereof will be omitted. With devices that operate using hydraulic pressure, operation is possible when hydraulic pressure of equal to or greater than a predetermined lower limit pressure is supplied. Similarly, a lower limit pressure is also set for the actuator 11, such that the actuator 11 operates when hydraulic pressure of equal to or greater than this lower limit pressure is supplied to the advance chamber or the retard chamber.

The engine 1 also includes an oil supply apparatus 20. The engine 1 has a plurality of portions that need to be lubricated, such as the bearings 5 described above. Other portions to be lubricated include, for example, a connecting rod bearing provided between the connecting rod 3 and the crankshaft 4, and a piston oil jet that sprays oil onto the back surface of the piston 2. The oil supply apparatus 20 supplies oil to the plurality of portions to be lubricated and the variable valve mechanism 10. The oil supply apparatus 20 includes an oil pump 23 that draws up oil (i.e., hydraulic fluid) stored in the oil pan 6 via an oil strainer 21 and an oil filter 22. A supply passage 24 is connected to a discharge side of the oil pump 23. As shown in the drawing, the supply passage 24 branches into a lubricant passage 25 and a hydraulic passage 26 at a branch point 24*a*. The lubricant passage 25 leads hydraulic fluid from the supply passage 24 to the plurality of portions to be lubricated, including the bearings 5. The hydraulic passage 26 leads oil from the supply passage 24 to the OCV 12. A flow regulating valve 27 capable of regulating the flowrate of hydraulic fluid that flows through the lubricant passage 25 is provided in the lubricant passage 25. A check valve 28 for preventing the backflow of hydraulic fluid from the OCV 12 to the supply passage 24 when the engine is stopped is provided in the hydraulic passage 26. The OCV 12 is connected to an intake side of the oil pump 23 by a return passage 29. Hydraulic fluid that spills out of the actuator 11 is returned to the intake side of the oil pump 23 via this return passage 29.

Operation of the, flow regulating valve 27 is controlled by an engine control unit (ECU) 30. The ECU 30 is a computer unit that includes a microprocessor peripheral devices such as RAM and ROM and the like that are necessary to operate the microprocessor. The ECU 30 controls devices to be controlled that are provided in the engine 1 according to a predetermined control program, and thus controls the engine 1 to a target operating state. For example, the ECU 30 controls the operation of a starter or the motor-generator such that cranking of the engine 1 is started when a predetermined start condition is satisfied. The start condition is determined to be satisfied when, for example, an ignition switch is switched on. Also, in an engine to which so-called idling stop control that stops the engine 1 when a predetermined stop condition is satisfied while the engine 1 is operating has been applied, the start condition may also be determined to be satisfied when a predetermined restart condition, such as an accelerator pedal being depressed or a shift gear being operated by the driver, is satisfied when the engine 1 is stopped by this idling stop control. In addition, the start condition may also be determined to be satisfied when a state-of-charge (SOC) of a battery mounted in the vehicle is less than a predetermined determining value. A coolant temperature sensor 31 that outputs a signal indicative of the temperature of coolant of the engine 1 in order to determine the operating state of the engine 1, and the like is connected to the ECU 30. Various other sensors, such as an engine speed sensor that outputs a signal indicative of the speed of the engine 1, are also connected to the ECU 30, but these are not shown.

The ECU 30 controls the operation of the variable valve mechanism 10 according to the operating state of the engine 1, and thus changes the relationship between the expansion ratio and the actual compression ratio of the engine 1. For example, while the engine 1 is operating, the ECU 30 controls the operation of the variable valve mechanism 10 to achieve a high expansion ratio in which the expansion ratio is greater than the actual compression ratio. As a result, the heat efficiency of the engine 1 improves. However, the temperature inside the cylinders during a compression stroke is lower with a smaller actual compression ratio. Therefore, at startup of the engine 1 when the temperature of the engine 1 is low and the actual compression ratio of the engine 1 is smaller than the expansion ratio, the temperature inside the cylinders will be low so startability will deteriorate. Thus, in this case, the operation of the variable valve mechanism 10 is controlled such that the actual compression ratio approaches the expansion ratio. As described above, the variable valve mechanism 10 operates by hydraulic pressure, so the ECU 30 ensures that hydraulic fluid is delivered to the variable valve mechanism 10 by controlling the operation of the flow regulating valve 27 when operating the variable valve mechanism 10 at startup of the engine 1.

Figure 2:
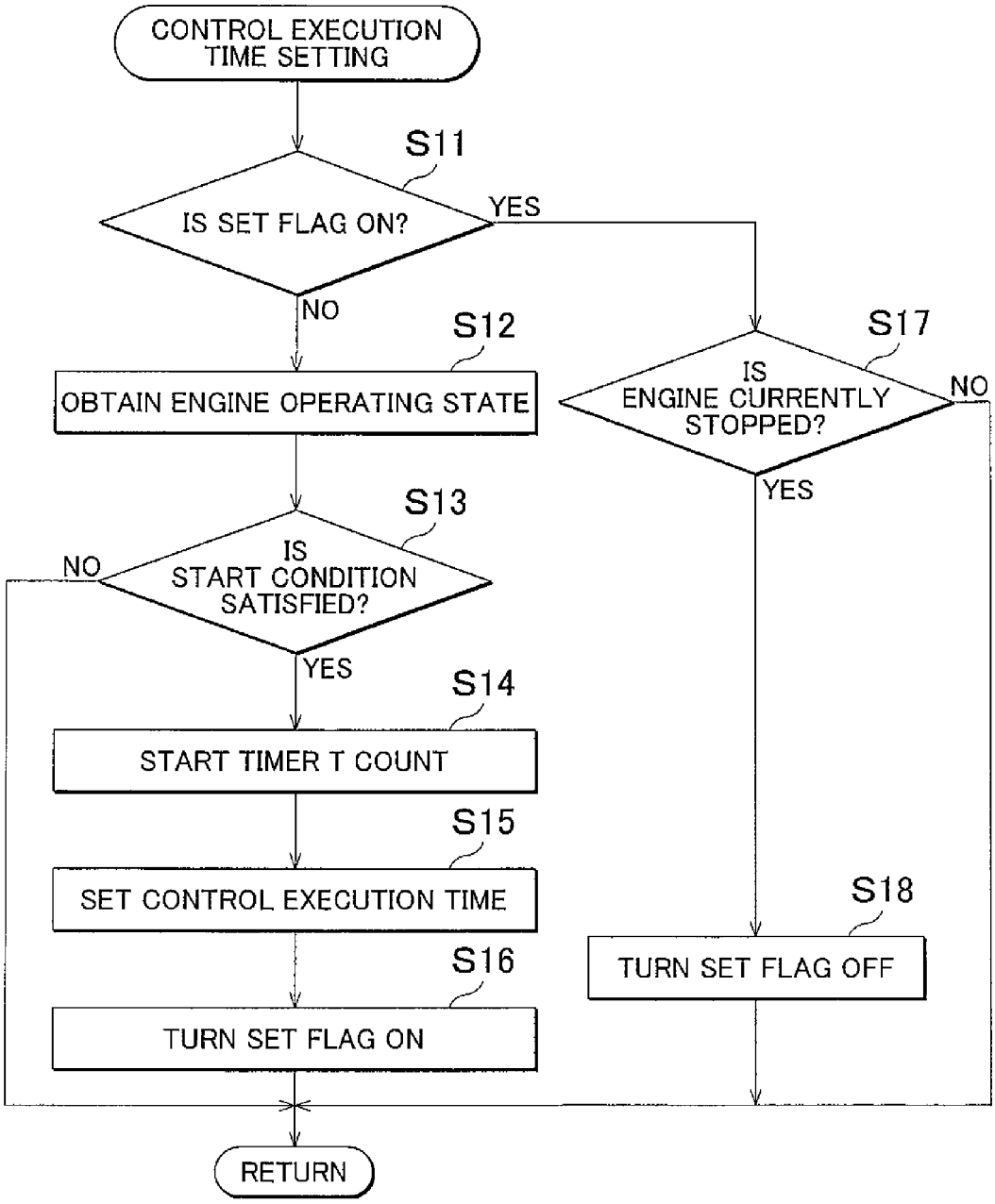
FIG. 2 is a flowchart illustrating a control execution time setting routine that is executed by an ECU, according to the example embodiment of the invention.
Figure 3:
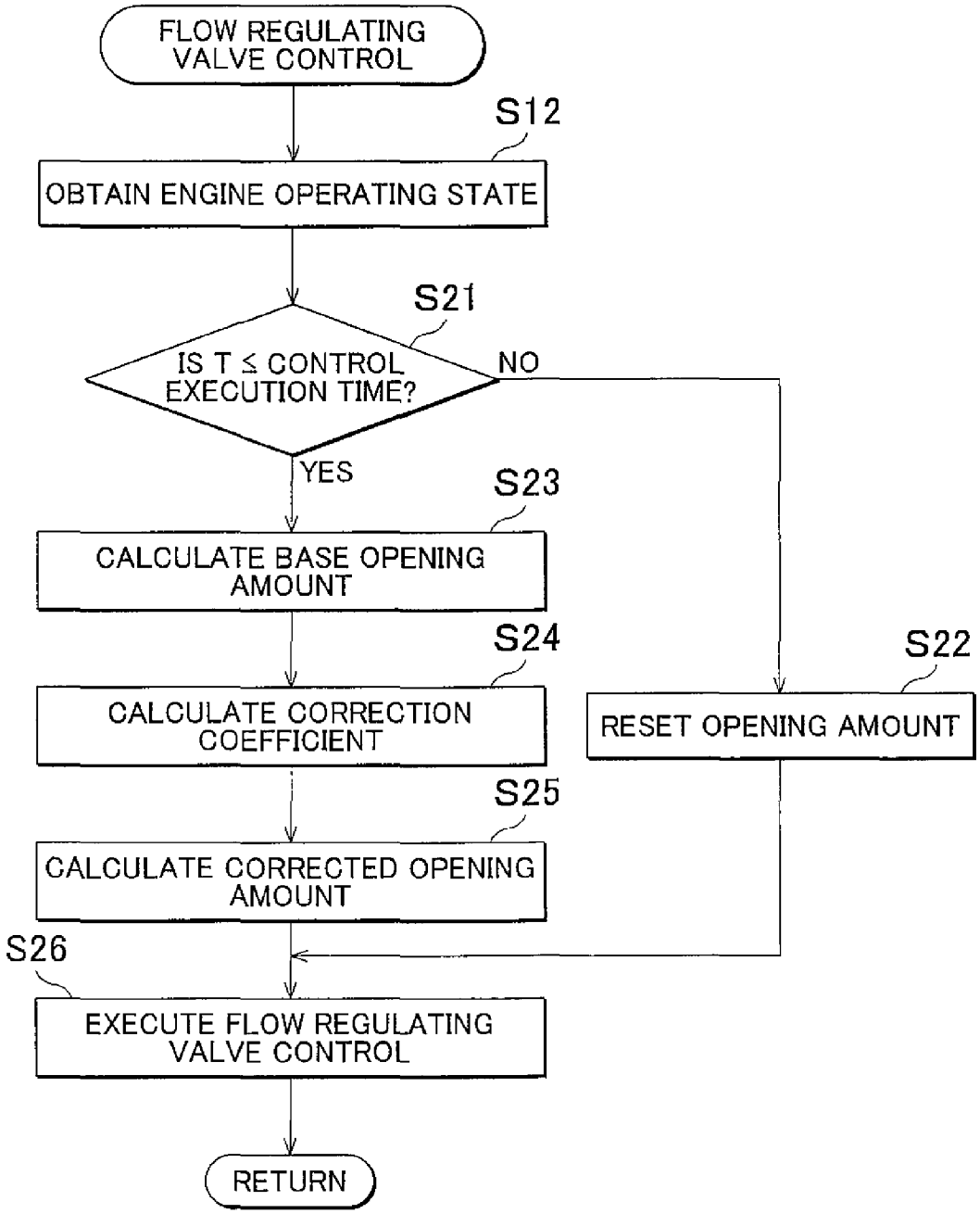
FIG. 3 is a flowchart illustrating a flow regulating valve control routine that is executed by an ECU, according to the example embodiment of the invention.

FIGS. 2 and 3 are views illustrating routines executed by the ECU 30 in order to perform this kind of control. FIG. 2 is a routine for setting a control execution time (i.e., a period of time for which control execution is to be performed) used in the routine in FIG. 3. FIG. 3 is a routine for controlling the operation of the flow regulating valve 27. The ECU 30 serves as a control apparatus of the invention by executing these routines. First, the routine in FIG. 2 will be described. The ECU 30 repeatedly executes the control execution time setting routine shown in FIG. 2 at predetermined cycles regardless of the state of the engine 1.

In the routine in FIG. 2, the ECU 30 first determines in step S11 whether a set flag is on. The set flag is a flag that indicates whether the control execution time has already been set. The state of the set flag is stored in the RAM or the like of the ECU 30. If it is determined that the set flag is off, the process proceeds on to step S12, where the ECU 30 obtains the operating state of the engine 1. The temperature of coolant or the like, for example, may be obtained as the operating state of the engine 1. Continuing on, in step S13, the ECU 30 determines whether the predetermined start condition described above is satisfied. If it is determined that the start condition is not satisfied, this cycle of the routine ends.

Figure 4:
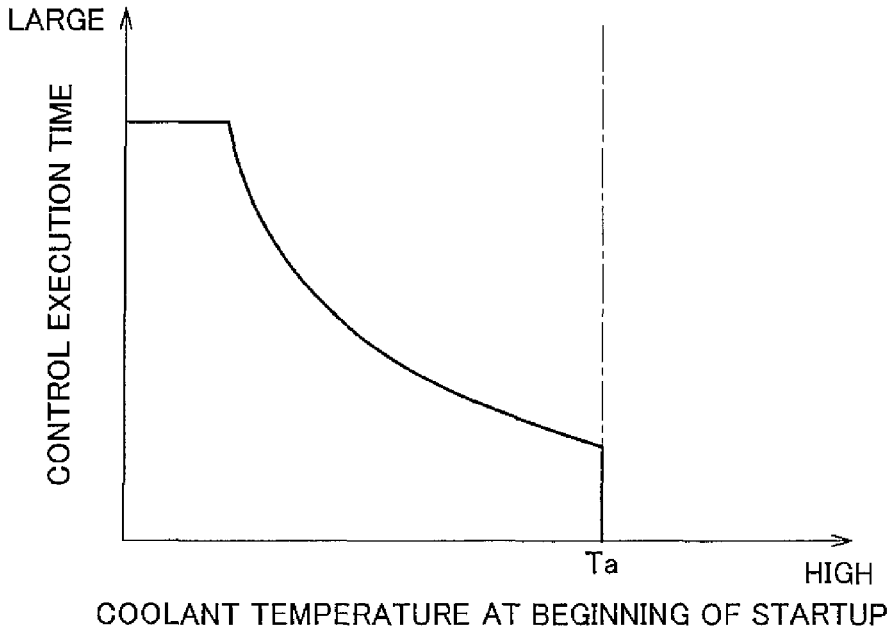
FIG. 4 is a view of one example of the relationship between the coolant temperature at the beginning of startup and the control execution time, according to the example embodiment of the invention.

If, on the other hand, it is determined that the start condition is satisfied, the process proceeds on to step S14, where the ECU 30 resets a timer T for measuring a time that has passed after cranking of the engine 1 starts, and then starts a count of the timer T. Next, in step S15, the ECU 30 sets the control execution time. This control execution time is the period of time for which to control the operation of the flow regulating valve 27 so that the pressure of hydraulic fluid that is delivered to the variable valve mechanism 10 when the engine 1 is started will become equal to or greater than a predetermined target pressure. The lower the temperature of the engine 1 at the beginning of startup, the longer it takes for the temperature of the engine 1 to rise to a temperature suitable for operation. Therefore, the control execution time may be set based on the temperature of coolant at the beginning of startup so as to be longer with a lower temperature of the coolant of the engine 1 at the beginning of startup, for example. More specifically, the control execution time may be set referencing a map such as that shown in FIG. 4, for example. The relationship between the temperature of the coolant at the beginning of startup and the control execution time shown in the drawing may be obtained by, for example, numerical calculation or testing in advance and stored in the ROM of the ECU 30. The temperature Ta shown in the drawing is set taking into account, for example, the temperature at which the viscosity of the hydraulic fluid suddenly starts to rise, the temperature at which the output of the motor-generator becomes limited in view of the temperature characteristic of the battery that is connected to the motor-generator, and the temperature at which combustion of the engine 1 suddenly deteriorates. The temperature Ta set in this way is a temperature that is below the freezing point or that is near the freezing point, for example.

Next, in step S16, the ECU 30 switches the set flag on, which indicates that the control execution time has already been set. Then this cycle of the control routine ends.

If it is determined in step S11 that the set flag is on, the process proceeds on to step S17, where the ECU 30 determines whether the engine 1 is currently stopped. This determination may be made by a known determination method performed based on the speed of the engine 1, for example. If it is determined that the engine 1 is being started or is operating, then this cycle of the control routine ends. If, on the other hand, if it is determined that the engine 1 is currently stopped, the process proceeds on to step S18, where the ECU 30 switches the set flag off. Then this cycle of the control routine ends.

Next, the flow regulating valve control routine in FIG. 3 will be described. This control routine is repeatedly executed at predetermined cycles while the engine 1 is operating. Steps in FIG. 3 that are the same as those in FIG. 2 will be denoted by like reference characters and descriptions of those steps will be omitted.

In this control routine, first in step S12, the ECU 30 obtains the operating state of the engine 1. Then in step S21, the ECU 30 determines whether the value of the timer T is equal to or less than the control execution time. If the value of the timer T is greater than the control execution time, then the process proceeds on to step S22, where the ECU 30 sets the control target opening amount of the flow regulating valve 27 to fully open, and then resets the opening amount of the flow regulating valve 27.

Figure 5:
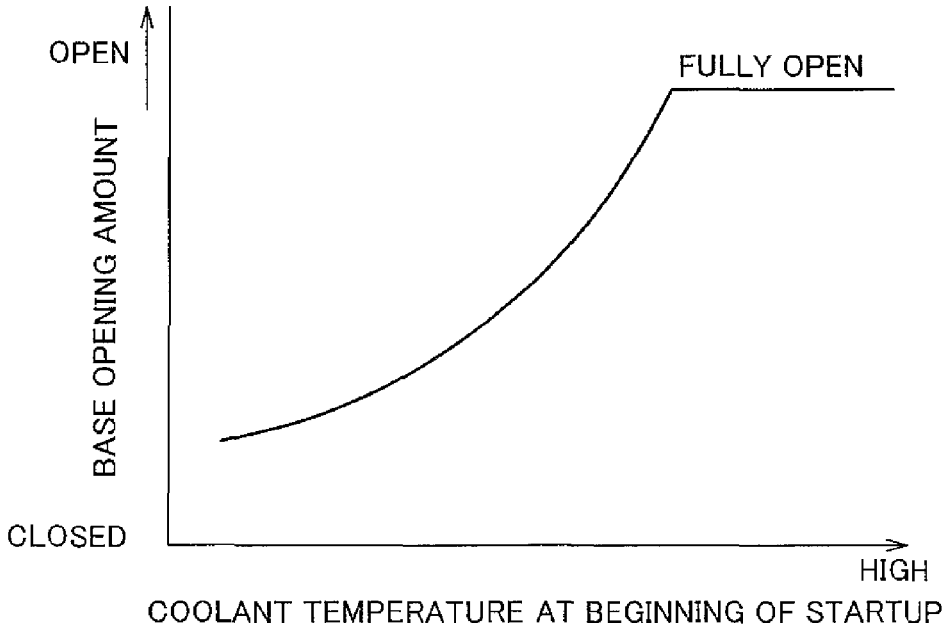
FIG. 5 is a view of one example of the relationship between the coolant temperature at the beginning of startup and the base throttle amount, according to the example embodiment of the invention.

If, on the other hand, the value of the timer T is equal to or less than the control execution time, the process proceeds on to step S23, where the ECU 30 calculates a base opening amount that is to be the base of the control target opening amount of the flow regulating valve 27. This base opening amount is set such that the pressure of the hydraulic fluid that is delivered to the variable valve mechanism 10 when the engine 1 is cranked becomes equal to or greater than a preset target pressure. The target pressure may be set based on the lower limit pressure of the actuator 11 described above. For example, a pressure that is slightly higher than the lower limit pressure may be set as the target pressure. Also, the temperature inside the cylinder during the compression stroke becomes lower as the actual compression ratio decreases, as described above. Therefore, the lower the temperature of the engine 1 at the beginning of startup, the larger the increase in the amount of hydraulic fluid that is led to the hydraulic passage 26, which enables the variable valve mechanism 10 to be operated earlier. This kind of base opening amount may be calculated based on a map such as that shown in FIG. 5, for example. The relationship between the temperature of the coolant at the beginning of startup and the base opening amount shown in the drawing may be obtained by, for example, numerical calculation or testing in advance and stored in the ROM of the ECU 30.

Figure 6:
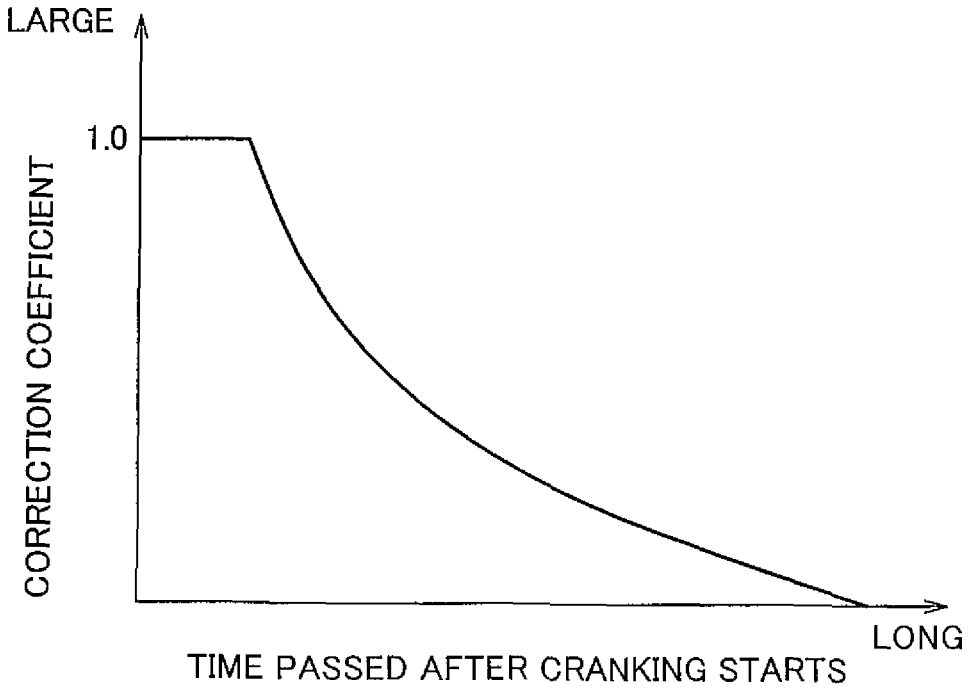
FIG. 6 is a view of one example of the relationship between the time passed after the start of cranking and a correction coefficient, according to the example embodiment of the invention.

Next, in step S24, the ECU 30 calculates a correction coefficient. This correction coefficient is a coefficient for correcting the base opening amount, and is calculated to be a smaller value as more time passes after cranking starts. More specifically, the correction coefficient may be calculated based on a map such as that shown in FIG. 6, for example. The correction coefficient such as that shown in the drawing is set to a numerical value between 0 and 1, inclusive. The relationship between the temperature of the coolant at the beginning of cranking and the base opening amount shown in the drawing may be obtained by, for example, numerical calculation or testing in advance and stored in the ROM of the ECU 30. Next, in step S25, the ECU 30 calculates a corrected opening amount by multiplying the correction coefficient by the base opening amount.

After obtaining the opening amount of the flow regulating valve 27 in step S22 or step S25, the process proceeds on to step S26, where the ECU 30 controls the operation of the flow regulating valve 27 to achieve the obtained opening. Then this cycle of the control routine ends.

As described above, with the oil supply apparatus according to this example embodiment of the invention, if the temperature of the engine 1 is low when the engine 1 is started, the flow regulating valve 27 is controlled in the closing direction to increase the amount of hydraulic fluid delivered to the variable valve mechanism 10. As a result, the pressure of the hydraulic fluid that is delivered to the variable valve mechanism 10 when the engine 1 is being cranked increases to equal to or greater than the target pressure, so the variable valve mechanism 10 is able to be operated from the time the engine 1 is started. Consequently, the actual compression ratio of the engine 1 is able to be brought close to the expansion ratio by changing the closing timing of the intake valve using the variable valve mechanism 10. Therefore, the temperature inside the cylinder can be quickly raised at startup, so starting performance of the engine 1 may be improved.

Also, with the oil supply apparatus according to this example embodiment of the invention, the correction coefficient is reduced more as more time passes after cranking of the engine 1 starts. Therefore, the flow regulating valve 27 is controlled further in the opening direction from the initial opening amount initially set at the beginning of startup as more time passes after cranking of the engine 1 starts. Controlling the flow regulating valve 27 in this way increases the amount of hydraulic fluid that is delivered to the plurality of portions to be lubricated, including the bearings 5, thereby making it possible to prevent these portions from seizing.

Moreover, with the oil supply apparatus according to this example embodiment of the invention, the initial opening amount of the flow regulating valve 27 initially that is set at the beginning of startup is set such that the lower the temperature of the engine 1 at the beginning of startup, the smaller the amount of hydraulic fluid that is led to the portions to be lubricated. By setting the initial opening amount in this way, more hydraulic fluid is led to the hydraulic passage 26 when the temperature of the engine 1 at the beginning of startup is lower, so the variable valve mechanism 10 is able to be operated at an earlier timing. Therefore, the temperature of the engine 1 is able to be increased rapidly at startup, so starting performance of the engine 1 may be improved.

As described above, a first aspect of the invention relates to an oil supply apparatus applied to an internal combustion engine provided with a variable valve mechanism that is driven by hydraulic pressure. This oil supply apparatus includes an oil pump that is driven by the internal combustion engine; a supply passage that is connected to a discharge side of the oil pump; a lubricant passage that leads hydraulic fluid from the supply passage to a portion to be lubricated that is provided in the internal combustion engine; a hydraulic passage that leads hydraulic fluid from the supply passage to the variable valve mechanism; a flow regulating valve capable of regulating a flowrate of hydraulic fluid that flows through the lubricant passage; and a control apparatus that controls the flow regulating valve in a closing direction at startup of the internal combustion engine such that a pressure of hydraulic fluid that is led to the variable valve mechanism when the internal combustion engine is being cranked comes to be equal to or greater than a predetermined target pressure.

According to the oil supply apparatus of this aspect of the invention, the flow regulating valve is controlled in the closing direction when the internal combustion engine is being started up, and as a result, the pressure of hydraulic fluid that is led to the variable valve mechanism when the internal combustion engine is being cranked may be quickly made equal to or greater than the target pressure. Therefore, the variable valve mechanism can be operated from the time that the internal combustion engine is started, by appropriately setting the target pressure.

In the oil supply apparatus according the aspect described above, the control apparatus may control the flow regulating valve to open farther from an initial opening amount initially set at startup of the internal combustion engine as more time passes after cranking of the internal combustion engine starts. According to this structure, the amount of hydraulic fluid that is delivered to the portion to be lubricated increases as more time passes after cranking of the internal combustion engine starts. As a result, seizure of the portion to be lubricated due to the amount of hydraulic fluid that is delivered to the portion to be lubricated being insufficient can be prevented.

In the oil supply apparatus described above, the control apparatus may change the initial opening amount of the flow regulating valve such that the lower a temperature at the beginning of startup of the internal combustion engine, the smaller an amount of hydraulic fluid that is led to the portion to be lubricated when the internal combustion engine is being cranked. According to this structure, the lower the temperature of the internal combustion engine at the beginning of startup, the greater the amount of hydraulic fluid that is led to the hydraulic passage is able to be. Therefore, the lower the temperature of the internal combustion engine at the beginning of startup, the earlier the timing at which the variable valve mechanism can be operated is able to be. In this case, the opening and closing timings of the intake valve and the like can be changed by operating the variable valve mechanism immediately after cranking starts, so starting performance of the internal combustion engine can be improved.

In the oil supply apparatus according to the aspect described above, the oil supply apparatus may be applied to an internal combustion engine capable of operating at a high expansion ratio in which an expansion ratio is greater than a compression ratio, by changing a valve characteristic of an intake valve using the variable valve mechanism. In this kind of internal combustion engine, the expansion ratio is made larger than the compression ratio during normal operation in order to improve heat efficiency. However, the temperature inside the cylinder during a compression stroke is decreases as the actual compression ratio that is determined by the actual intake air amount, not the mechanical compression ratio that is determined mechanically by a design value, decreases. Therefore, when the actual compression ratio is small, the rise in the temperature inside the cylinder when the internal combustion engine is started is gradual. With the oil supply apparatus structured as described above, the variable valve mechanism can be operated from the time of startup, so the actual compression ratio can be increased by changing the valve characteristic of the intake valve at startup. As a result, the temperature of the internal combustion engine can be quickly increased at startup, so starting performance of the internal combustion engine can be improved.

The oil supply apparatus according to the aspect described above may also include a check valve that is provided in the hydraulic passage, and that allows hydraulic fluid to flow from the supply passage to the variable valve mechanism and prevents hydraulic fluid from flowing from the variable valve mechanism to the supply passage. Providing a check valve in this way makes it possible to prevent hydraulic fluid from flowing back from the variable valve mechanism to the supply passage when the internal combustion engine is stopped. Therefore, hydraulic fluid can be prevented from flowing out of the hydraulic passage. When a check valve is provided, the line resistance of the hydraulic passage increases, but with the structure described above, the flowrate of the hydraulic fluid that is delivered to the variable valve mechanism can be regulated by adjusting the opening amount of the flow regulating valve. Thus, the increase in line resistance due to providing the check valve can be compensated for by adjusting the opening amount of the flow regulating valve. Therefore, the flowrate of hydraulic fluid that is delivered to the variable valve mechanism can be prevented from decreasing.

The invention is not limited to the example embodiment described above, but may be carried out in any of a variety of modes. For example, the internal combustion engine to which the invention may be applied is not limited to an internal combustion engine capable of operating at a high expansion ratio in which the expansion ratio is greater than the actual compression ratio. The invention may also be applied to an internal combustion engine in which the actual compression ratio and the expansion ratio are substantially the same. Also, the internal combustion engine to which the invention may be applied is not limited to an internal combustion engine for a hybrid vehicle. The invention may be applied to an internal combustion engine that is mounted in any of a variety of types of vehicles.

The internal combustion engine to which the invention is applied is not limited to an internal combustion engine in which a variable valve mechanism is provided only on the intake-side camshaft. The invention may also be applied to an internal combustion engine in which a variable valve mechanism is provided on at least one of the intake-side camshaft and the exhaust side camshaft.

In the example embodiment described above, the temperature of the coolant of the internal combustion engine is referenced as the temperature of the internal combustion engine, but the temperature of the hydraulic fluid may be referenced instead of the temperature of the coolant.

In the example embodiment described above, the opening amount of the flow regulating valve is controlled to be greater (i.e., the flow regulating valve is controlled further in the opening direction) as more time passes after cranking starts, but the opening amount of the flow regulating valve during the control execution time may also be constant.

The invention claimed is:

1. An oil supply apparatus applied to an internal combustion engine provided with a variable valve mechanism that is driven by hydraulic pressure, comprising:

an oil pump that is driven by the internal combustion engine;

a supply passage that is connected to a discharge side of the oil pump;

a lubricant passage that leads hydraulic fluid from the supply passage to a portion to be lubricated that is provided in the internal combustion engine;

a hydraulic passage that leads hydraulic fluid from the supply passage to the variable valve mechanism;

a flow regulating valve capable of regulating a flowrate of hydraulic fluid that flows through the lubricant passage; and an electronic control unit configured to control the flow regulating valve in a closing direction to an initial opening amount at startup of the internal combustion engine such that a pressure of hydraulic fluid that is led to the variable valve mechanism when the internal combustion engine is being cranked comes to be equal to or greater than a predetermined target pressure, the electronic control unit is configured to control the flow regulating valve to open from the initial opening amount upon a determination that cranking of the internal combustion engine starts and to open farther as more time passes;

wherein the electronic control unit is configured to control a change of the initial opening amount of the flow regulating valve such that the lower a temperature at the beginning of startup of the internal combustion engine, the smaller an amount of hydraulic fluid that is led to the portion to be lubricated when the internal combustion engine is being cranked.

2. The oil supply apparatus according to claim 1, wherein the oil supply apparatus is applied to an internal combustion engine capable of operating at a high expansion ratio in which an expansion ratio is greater than a compression ratio, by changing a valve characteristic of an intake valve using the variable valve mechanism.

3. The oil supply apparatus according to claim 1, further comprising a check valve that is provided in the hydraulic passage, and that allows hydraulic fluid to flow from the supply passage to the variable valve mechanism and prevents hydraulic fluid from flowing from the variable valve mechanism to the supply passage.

4. The oil supply apparatus according to claim 1, wherein the initial opening amount is corrected by multiplying a correction coefficient by the initial opening amount, and the correction coefficient is set to a predetermined value between 0 and 1 in accordance with the time which passes after cranking of the internal combustion engine starts.

5. A method, comprising:

providing the oil supply apparatus according to claim 1; and changing the initial opening amount of the flow regulating valve such that the lower a temperature at the beginning of startup of the internal combustion engine, the smaller an amount of hydraulic fluid that is led to the portion to be lubricated when the internal combustion engine is being cranked.

* * * * *